US012757985B2

(12) United States Patent
Ding

(10) Patent No.: US 12,757,985 B2
(45) Date of Patent: Oct. 13, 2026

(54) ELECTRICALLY-OPERATED OPENING AND CLOSING STRUCTURE OF SOLAR-CHARGED UMBRELLA

(71) Applicant: AFTERCLOUD TECHNOLOGY CO., LTD., Quanzhou City (CN)

(72) Inventor: Shunfeng Ding, Quanzhou City (CN)

(73) Assignee: AFTERCLOUD TECHNOLOGY CO., LTD., Quanzhou City (CN)

( * ) Notice: Subject to any disclaimer, the term of this patent is extended or adjusted under 35 U.S.C. 154(b) by 253 days.

(21) Appl. No.: 18/811,809

(22) Filed: Aug. 22, 2024

(65) Prior Publication Data

US 2026/0053242 A1 Feb. 26, 2026

(51) Int. Cl.

| | |
|---|---|
| ***A45B 25/16*** | (2006.01) |
| ***A45B 25/10*** | (2006.01) |
| ***A45B 25/14*** | (2006.01) |

(52) U.S. Cl.

CPC ..... *A45B 25/165* (2013.01); *A45B 25/10* (2013.01); *A45B 25/143* (2013.01); *A45B 2200/1027* (2013.01)

(58) Field of Classification Search

None

See application file for complete search history.

(56) References Cited

U.S. PATENT DOCUMENTS

| | | | | |
|---|---|---|---|---|
| 10,959,500 | B1 * | 3/2021 | Holbrook | A45B 23/00 |
| 2008/0190469 | A1 * | 8/2008 | Amsel | A45B 19/00 135/22 |
| 2009/0145469 | A1 * | 6/2009 | Pirlo | A45B 25/143 135/23 |
| 2026/0020649 | A1 * | 1/2026 | Ruan | A45B 17/00 |
| 2026/0020650 | A1 * | 1/2026 | Ruan | A45B 25/143 |

FOREIGN PATENT DOCUMENTS

| | | | | |
|---|---|---|---|---|
| CN | 111557528 A | * | 8/2020 | A45B 11/00 |

* cited by examiner

*Primary Examiner* — David R Dunn
*Assistant Examiner* — Danielle Jackson
(74) *Attorney, Agent, or Firm* — Leong C. Lei

(57) ABSTRACT

An electrically-operated opening and closing structure of a solar-charged umbrella includes a rib assembly and an electrically-operated opening and closing mechanism. When the drive motor of the electrically-operated opening and closing mechanism is started, the screw rod is driven to rotate and the movable disk connected to the screw rod is driven to move up and down so that the movable end of the rib of the rib assembly is driven to slide on a guide rail of the movable disk, thereby changing the angle of the rib to be opened/closed for the umbrella to be opened/closed. The umbrella may be controlled remotely, automatically closed for protection against strong wind, and automatically opened for charging under sunlight.

10 Claims, 10 Drawing Sheets

ELECTRICALLY-OPERATED OPENING AND CLOSING STRUCTURE OF SOLAR-CHARGED UMBRELLA

BACKGROUND OF THE INVENTION

1. Field of the Invention

The present invention relates to an umbrella, and more particularly to an electrically-operated opening and closing structure of a solar-charged umbrella.

2. Description of the Prior Art

Outdoor umbrellas are commonly used in our daily life, consisting of an umbrella canopy, ribs, runners and poles. A conventional umbrella is opened and closed by pushing and pulling a lower runner manually. With the development of technology, automatic umbrellas are developed on the market. However, in most of the existing automatic umbrellas, the lower runner is driven to move up through a compressed spring. The impact of opening the umbrella is large, and it is impossible to control the degree of opening and closing, which is not suitable for large umbrellas such as outdoor umbrellas.

Chinese Patent Application No. 201810632718.0 discloses an electrically-operated support device of a solar-charged umbrella. The umbrellas is opened/closed by means of electric actuation. However, when in use, the installation and maintenance of the runner assembly are complicated, and the entire assembly is prone to wear and tear during operation.

SUMMARY OF THE INVENTION

The primary object of the present invention is to provide an electrically-operated opening and closing structure of a solar-charged umbrella, which is simpler for installation and maintenance.

In order to achieve the foregoing object, the present invention adopts the following technical solutions:

An electrically-operated opening and closing structure of a solar-charged umbrella comprises a rib assembly and an electrically-operated opening and closing mechanism. The rib assembly includes a main rib and a solar panel assembly. The electrically-operated opening and closing mechanism includes a base, a drive motor, a screw rod, a movable disk, and an immovable disk. The immovable disk is fixedly connected to an upper end of the base. The movable disk is located inside the base. The drive motor is located under the base and connected to a lower end of the screw rod. The electrically-operated opening and closing mechanism and the rib assembly are connected through a first connecting member. The movable disk has a central hole with an internal thread meshing with the screw rod. An outer side of the movable disk has a guide rail corresponding in number to the main rib. The screw rod passes through the central hole of the movable disk.

A front end of the first connecting member has a first connecting portion and a second connecting portion. A rear end of the first connecting member is fixedly connected to the main rib. A rolling member is provided on the first connecting portion. The rolling member is fitted on the guide rail and reciprocated along the guide rail. The second connecting portion is hingedly connected to the base, and the hinge point serves as the rotational fulcrum of the rib assembly. The movable disk is moved axially relative to the base and drives the first connecting portion to rotate about the hinge point. The first connecting portion and the rolling member form a movable end of the rib.

Preferably, the first connecting portion is in the form of two lugs.

Furthermore, a rib mounting seat is provided on one side of the base. The rib assembly is hingedly connected to the rib mounting seat. Specifically, the second connecting portion of the first connecting member is connected to the rib mounting seat, for example, by screws.

Preferably, a travel switch is provided on an inner wall of the base for restricting an upward and downward movement of the movable disk. The travel switch is connected to the drive motor through wiring.

Preferably, a motor mounting seat of the drive motor is provided under the base. The motor mounting seat is in the form of a hollow tube. A coupler assembly is provided in the motor mounting seat. The coupler assembly connects the drive motor and the screw rod for transmitting the torque of the drive motor to the screw rod.

Preferably, the coupler assembly consists of two couplers. A spring is provided on an upper one of the two couplers, so as to prevent the two couplers from coming out. Specifically, a bearing is provided at each of the upper and lower ends of the screw rod to assist the rotation of the screw rod.

Preferably, a decorative cover is provided on an outside of the electrically-operated opening and closing mechanism. The decorative cover includes an upper decorative cover and a lower decorative cover that are relatively closed to prevent the components of the electrically-operated opening and closing mechanism from being exposed, thereby forming a closed protection and improving the overall aesthetics.

Furthermore, a photosensitive sensor is provided on the immovable disk. The photosensitive sensor is driven by the drive motor. When the sunshine reaches the set value, the umbrella can be automatically opened and charged.

Furthermore, a second connecting member is mounted on top of the first connecting member. The second connecting member is an elongate plate with a raised step. The solar panel assembly is fixed to the main rib through the second connecting member and the first connecting member.

Furthermore, the solar panel assembly includes a solar panel, a bracket, and a conductive connector. The bracket is slidably inserted in the second connecting member. The bracket has a mounting groove. The solar panel is slidably inserted and secured in the mounting groove. The conductive connector is located below the bracket. The conductive connector connects the charging circuit of the solar panel to a battery.

In the present, when the drive motor is started, the screw rod is driven to rotate and the movable disk connected to the screw rod is driven to move up and down, thereby driving the movable end of the rib to roll on the guide rail of the movable disk. Besides, the upward and downward movement of the movable disk drives the first connecting portion to rotate about the hinge point, thereby changing the angle of the rib to be opened/closed, such that the umbrella can be opened/closed. The entire structure is simple, easy to install and maintain, stable in opening and closing, and has better aesthetics.

BRIEF DESCRIPTION OF THE DRAWINGS

These and/or other aspects will become apparent and more readily appreciated from the following description of the embodiments, taken in conjunction with the accompanying drawings, in which.

DETAILED DESCRIPTION OF THE PREFERRED EMBODIMENTS

Figure 1:
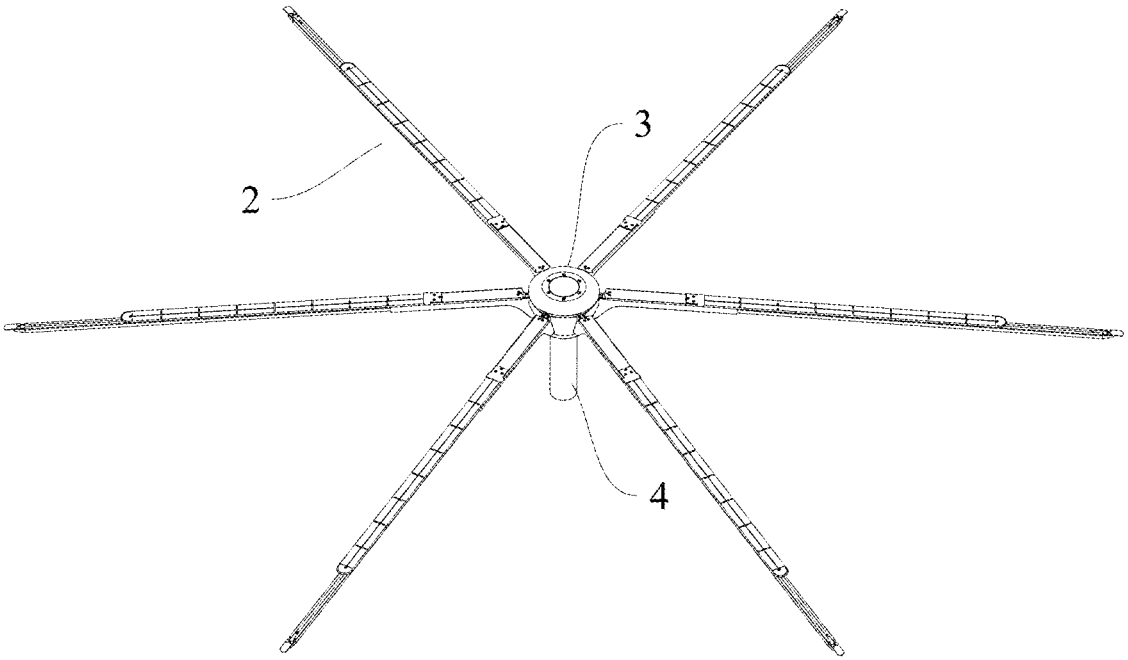
FIG. 1 is a perspective view of the electrically-operated opening and closing structure of the solar-charged umbrella in accordance with a preferred embodiment of the present invention.
Figure 2:
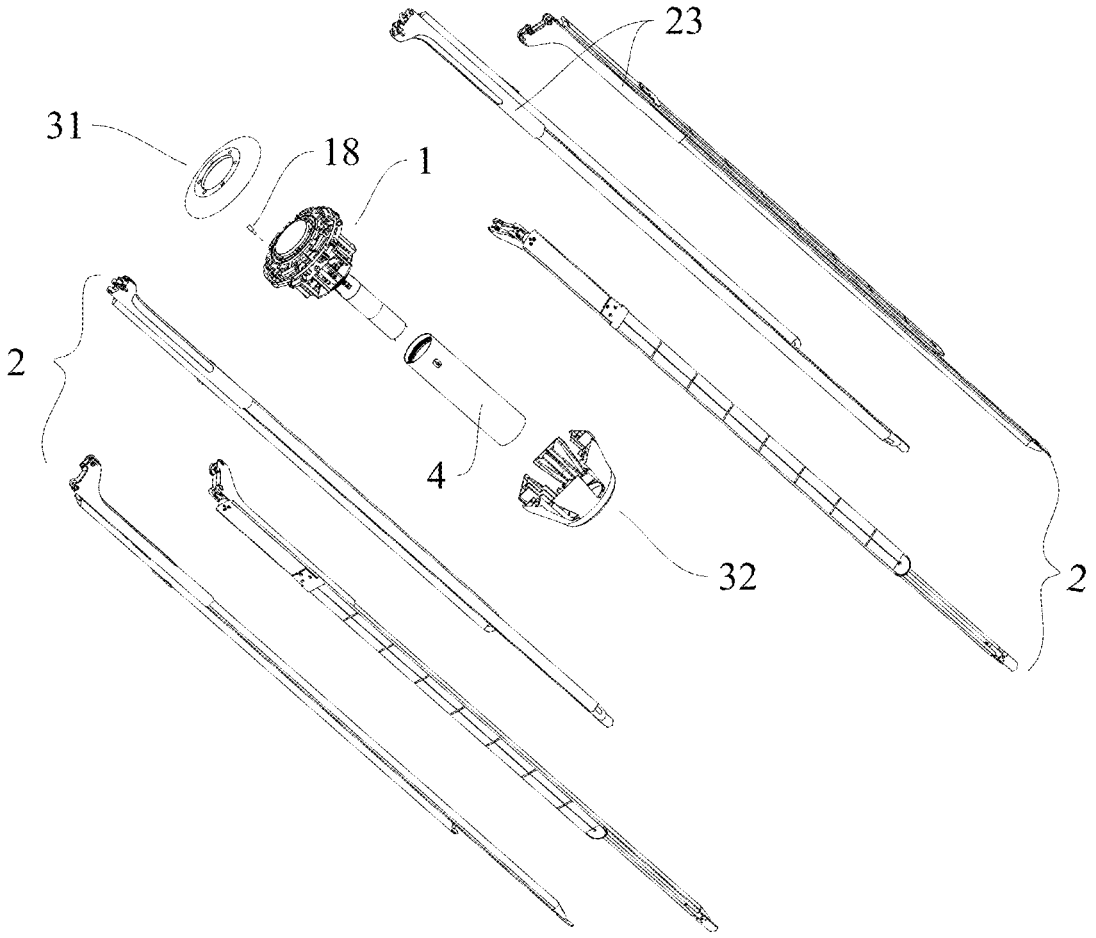
FIG. 2*a* is an exploded view of the rib assembly and the electrically-operated opening and closing mechanism in accordance with the preferred embodiment of the present invention.
FIG. 2*b* is a partial enlarged view of the first connecting member in accordance with the preferred embodiment of the present invention.
Figure 2:
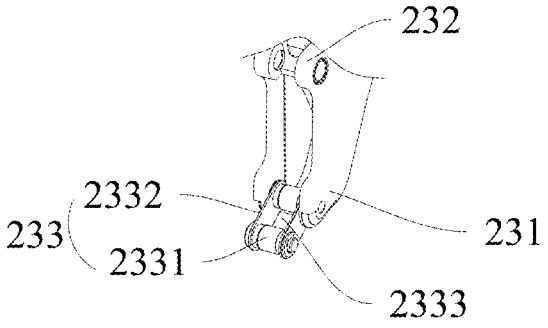

Embodiments of the present invention will now be described, by way of example only, with reference to the accompanying drawings.

While the present invention is susceptible of embodiment in various forms, as shown in the drawings, hereinafter will be described the presently preferred embodiments of the invention with the understanding that the present disclosure is to be considered as an exemplification of the invention, and it is not intended to limit the invention to the specific embodiments illustrated.

FIGS. 1 to 10 illustrate a preferred embodiment of the present invention. For ease of illustration, the umbrella has six ribs as an example in this embodiment. As shown in FIG. 1 and FIG. 2*a*, the present invention discloses an electrically-operated opening and closing structure of a solar-charged umbrella, comprising a rib assembly 2 having a solar panel 221 and an electrically-operated opening and closing mechanism 1. The electrically-operated opening and closing mechanism 1 and the rib assembly 2 are connected through a first connecting member 23. The rib assembly 2 includes a main rib 21 and a solar panel assembly 22. Preferably, the electrically-operated opening and closing mechanism 1 is covered and protected by a decorative cover 3 composed of an upper decorative cover 31 and a lower decorative cover 32. The upper decorative cover 31 covers an immovable disk 15. The lower decorative cover 32 is fitted onto a central shaft 4 and encircles the entire electrically-operated opening and closing mechanism 1.

Figure 3A:
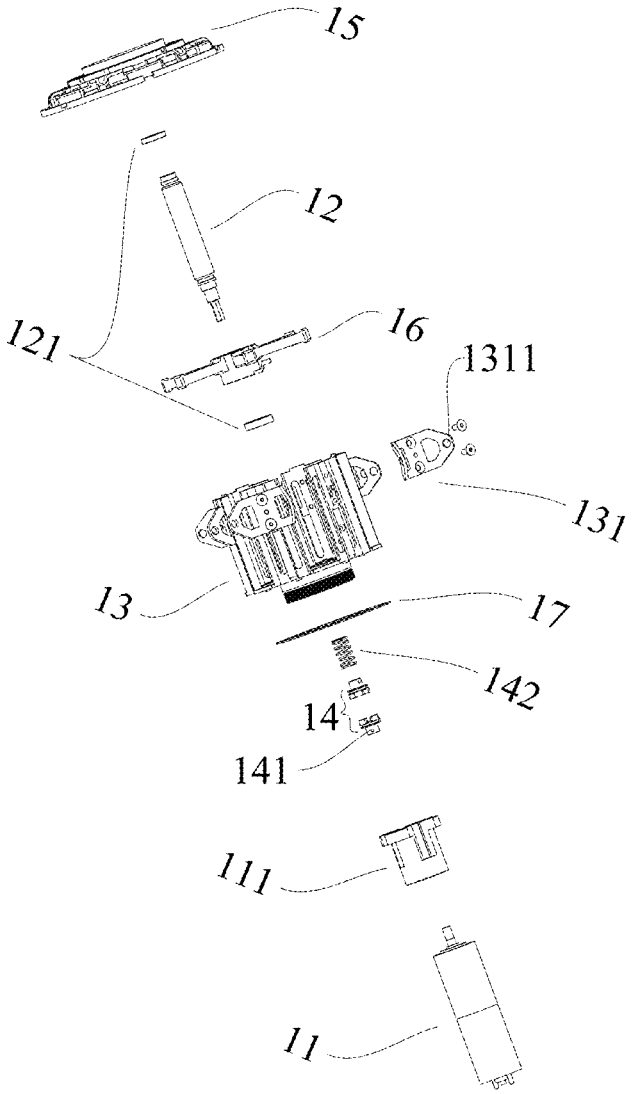
FIG. 3*a* is an exploded view of the electrically-operated opening and closing mechanism in accordance with the preferred embodiment of the present invention.
Figure 3B:
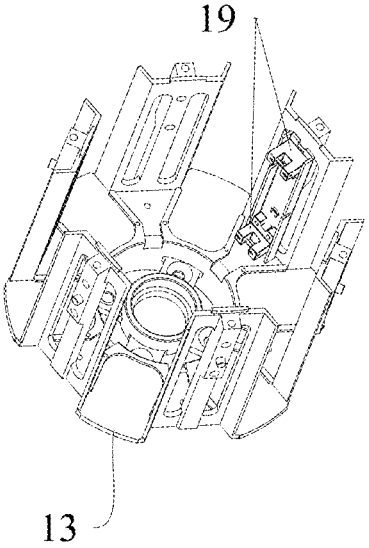
FIG. 3*b* is a perspective view of the base in accordance with the preferred embodiment of the present invention.
Figure 4A:
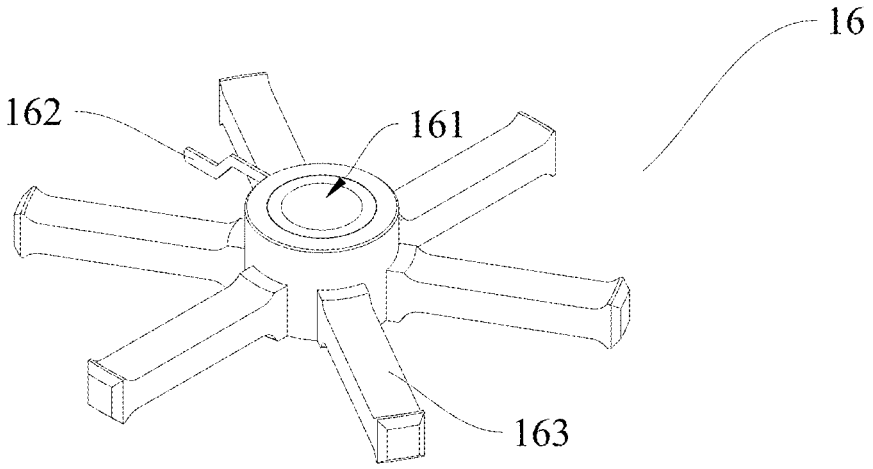
FIG. 4*a* is a perspective view of the movable disk in accordance with the preferred embodiment of the present invention.
Figure 4B:
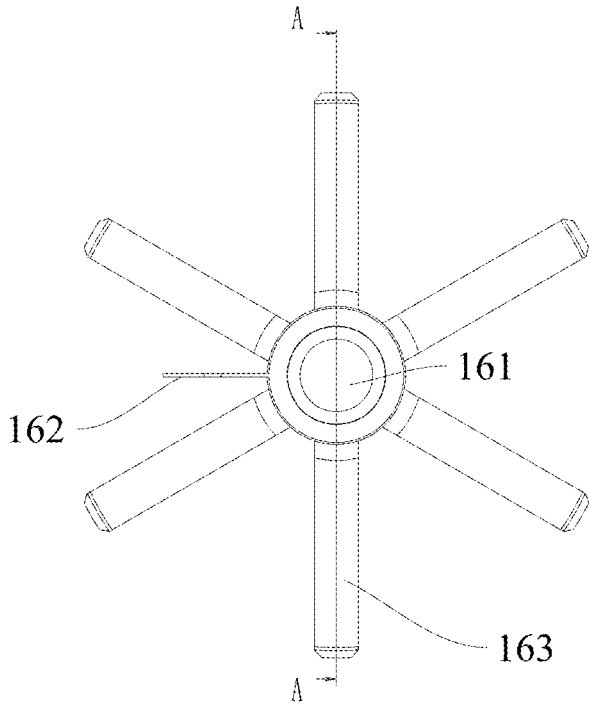
FIG. 4*b* is a top view of the movable disk in accordance with the preferred embodiment of the present invention.
Figure 4C:
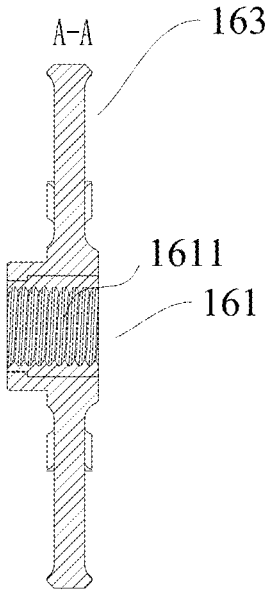
FIG. 4*c* is a cross-sectional view taken along line A-A of FIG. 4*b;*

As shown in FIG. 3*a*, the electrically-operated opening and closing mechanism 1 includes a base 13, a drive motor 11, a screw rod 12 (the threads of the screw rod are not shown in the figures), a movable disk 16, and an immovable disk 15. The base 13 is configured for mounting and fixing various components of the electrically-operated opening and closing mechanism 1. A travel switch 19 is provided on the inner wall of the base 13, as shown in FIG. 3*b*. The travel switch 19 is connected to the drive motor 11. The movable disk 16 is located inside the base 13 and moved up and down along the axis of the base 13. As shown in FIG. 4*a* and FIG. 4*b*, the movable disk 16 has a control lever 162. The control lever 162 interacts with the travel switch 19 to restrict the upward and downward movement of the movable disk 16. As shown in FIG. 4*c*, the movable disk 16 has a central hole 161 with an internal thread 1611 meshing with the screw rod 12. The outer side of the movable disk 16 has transverse guide rails 163 corresponding in number to the ribs. A main control circuit board 17 is mounted below the base 13 for aggregating and distributing the various circuits as well as mounting the various electronic control function modules. The main control circuit board 17 is connected to the drive motor 11 through wiring.

The drive motor 11 is a motor that can be rotated clockwise/counterclockwise. A motor mounting seat 111 is fixedly connected to the underside of the base 13. The drive motor 11 is mounted below the motor mounting seat 111. A coupler assembly 14 is provided above the motor mounting seat 111. The coupler assembly 14 connects the drive motor 11 and the screw rod 12 for transmitting the torque of the drive motor 11 to the screw rod 12. When the drive motor 11 fails, the couplers are separated up and down by a maintenance tool, so that the screw rod 12 is disengaged from the output shaft of the drive motor 11 to lose the brake constraint, so as to close the umbrella. When the drive motor 11 rotates clockwise/counterclockwise, it drives the screw rod 12 to rotate clockwise/counterclockwise, facilitating the movable disk 16 to move up and down, so as to realize the opening and closing of the umbrella. As shown in FIG. 3*a*, the coupler assembly 14 consists of two couplers 141. A spring 142 is provided on an upper one of the two couplers 141 to prevent the two couplers 141 from coming out. Specifically, a bearing 121 is provided at each of the upper and lower ends of the screw rod 12 to assist rotation of the screw rod 12. The upper end of the screw rod 12 and the bearing 121 are fixedly connected to the immovable disk 15. The screw rod 12 passes through the movable disk 16. The lower end of the screw rod 12 is fixedly connected to the coupler assembly 14. The immovable disk 15 is fixedly connected to the upper end of the base 13 by screws. A photosensitive sensor 18 is provided on the top of the immovable disk 15, as shown in FIG. 2*a*. The upper decorative cover 31 may be fully or partially a transparent plate corresponding in position to the photosensitive sensor 18, so as to facilitate the photosensitive sensor 18 to sense the change of the external light intensity. The photosensitive sensor 18 is driven by the drive motor. When the sunshine reaches the set value, the umbrella can be automatically opened and charged.

A rib mounting seat 131 is provided on one side of the base 13. The rib assembly 2 is hingedly connected to the rib mounting seat 131. The rib mounting seat 131 corresponds in number to the rib assembly 2. Specifically, the rib assembly 2 and the electrically-operated opening and closing mechanism 1 are connected through the first connecting member 23. The front end of the first connecting member 23 is connected to the rib mounting seat 131. The structure of the first connecting member 23 is as shown in FIG. 2*b*. The front end of the first connecting member 23 has a first connecting portion 231 and a second connecting portion 232, through which bolts or pins are inserted to form a fit with lugs. A rolling member 233 is connected to the first connecting portion 231 of the first connecting member 23. The rolling member 233 is fitted on the corresponding guide rail 163 and reciprocated along the corresponding guide rail 163 of the movable disk 16. Preferably, the rolling member 233 may include two rollers 2331 and connecting rods 2332 at two sides of the rollers 2331. A space 2333 is enclosed by the rollers and the connecting rods for the corresponding guide rail 163 to pass therethrough. The second connecting portion 232 is hingedly connected to the rib mounting seat 131 of the base 13. The hinge point 1311 serves as the rotational fulcrum for the opening and closing of the main rib 21 (refer to FIG. 8). The first connecting portion 231 and the rolling member 233 form the movable end of the rib. The rear end of the first connecting member 23 has a groove into which the main rib 21 is inserted and secured. As shown in the accompanying drawings, it is secured by screws. Preferably, a lighting panel 234 and a lampshade 235 are provided in the inner cavity of the first connecting member 23. Preferably, the first connecting portion 231 is in the form of two lugs. When the movable disk 16 is moved up and down along the axis of the base 13, the first connecting portion 231 is simultaneously driven to rotate about the hinge point 1311 along with the upward and downward movement of the moveable disk 16.

Figure 5:
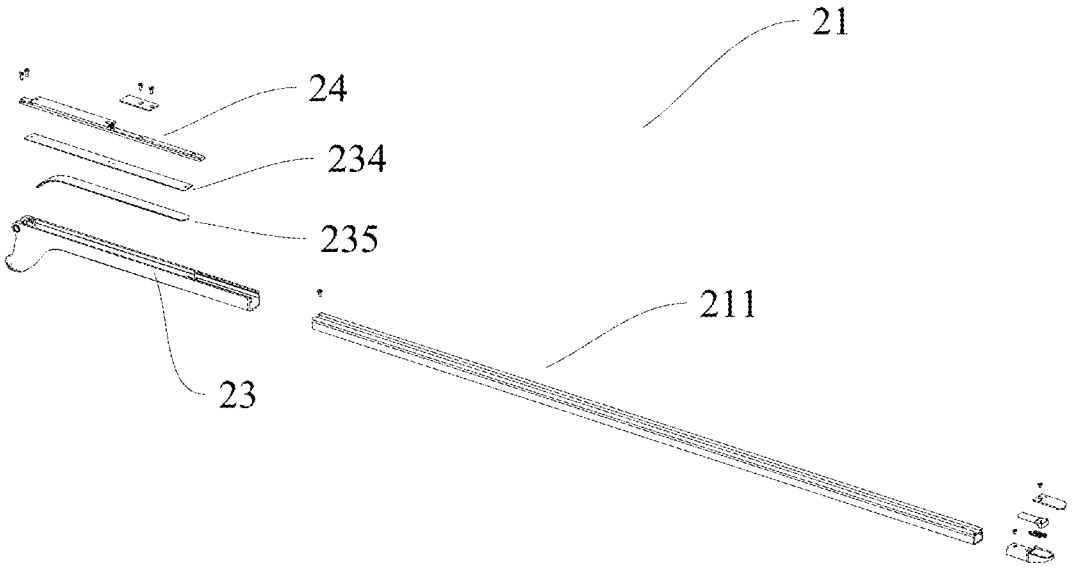
FIG. 5 is an exploded view of the main rib in accordance with the preferred embodiment of the present invention.

The main rib 21, as shown in FIG. 5, includes a rib pole 211. One end of the rib pole 211 has a mounting hole. After the first connecting member 23 is inserted, it is secured with a screw over the mounting hole. The main rib 21 is connected to the electrically-operated opening and closing mechanism 1 through the first connecting member 23.

Figure 6A:
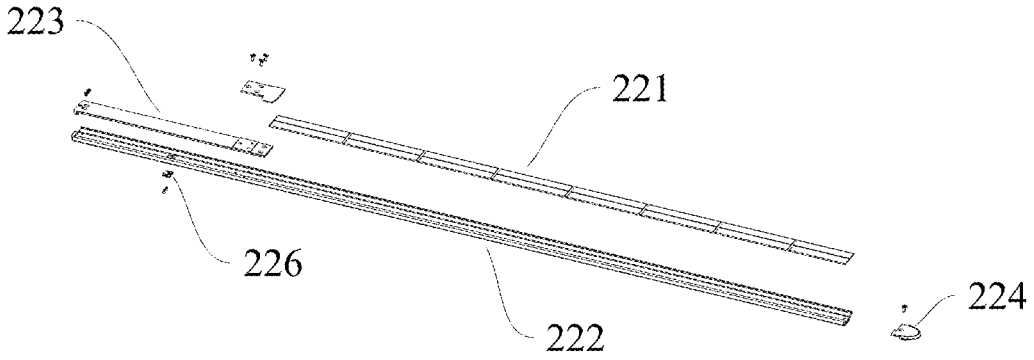
FIG. 6*a* is an exploded view of the solar panel assembly in accordance with the preferred embodiment of the present invention.
Figure 6B:
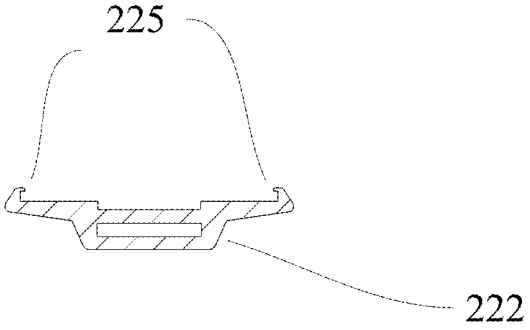
FIG. 6*b* is a cross-sectional view of the bracket in accordance with the preferred embodiment of the present invention.

As shown in FIG. 6*a* and FIG. 6*b*, the solar panel assembly 22 includes a bracket 222, a solar panel 221, and a conductive connector 226. The bracket 222 has a mounting groove 225 for mounting the solar panel 221. The solar panel 221 is slidably inserted into the mounting groove 225 and secured on the bracket 222 through a front plug 223 and a rear plug 224. The front plug 223 is fixed on the front end of the bracket 222 by a plurality of screws. The rear plug 224 is fixed on the rear end of the bracket 222 by a screw. The conductive connector 226 is disposed below the bracket 222. The conductive connector 226 connects the charging circuit of the solar panel 221 to a battery.

Figure 7:
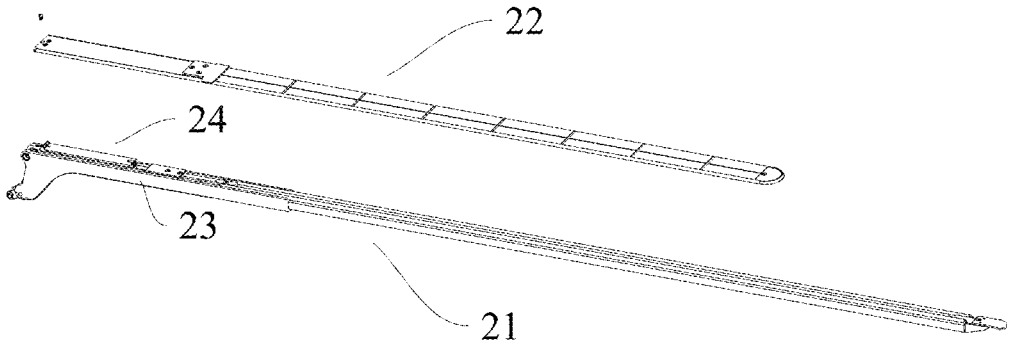
FIG. 7 is a schematic view showing the connection of the main rib and the solar panel assembly in accordance with the preferred embodiment of the present invention.

A second connecting member 24 is mounted on top of the first connecting member 23. The second connecting member 24 is an elongate plate with a raised step. The solar panel assembly 22 is fixed to the main rib 21 through the second connecting member 24. The second connecting member 24 has a conductive structure (not shown in the figures) that cooperates with the conductive connector 226. As shown in FIG. 7, the bracket 222 is slidably inserted in the second connecting member 24 and then fixed to the first connecting member 23. Specifically, the bracket 222 is matched with the raised step of the second connecting member 24. The bracket 222 has a notch where it forms a fit with the second connecting member 24. The solar panel assembly 22 is slidably inserted to the raised step of the second connecting member 24, providing an auxiliary retaining function. The solar panel assembly 22 is fixed on the first connecting member 23 through connecting screws, that is, it is fixed relative to the main rib 21.

When the rib assembly 2 is to be mounted, the lighting panel 234 and the lampshade 235 are first mounted in the inner cavity of the first connecting member 23. One end of the rib pole 211 is inserted and secured at the rear end of the first connecting member 23, and then the second connecting member 24 is mounted on top of the first connecting member 23. The rib pole 211, the first connecting member 23 and the second connecting member 24 are fixed through the corresponding mounting hole. Finally, the solar panel assembly 22 is slidably inserted in the second connecting member 24.

In an embodiment, the solar panel assembly 22 may be fixed on the main rib 21 by magnetic attraction. Specifically, magnets are provided on the bracket 222 and/or the rib pole 211 of the main rib 21.

Figure 8:
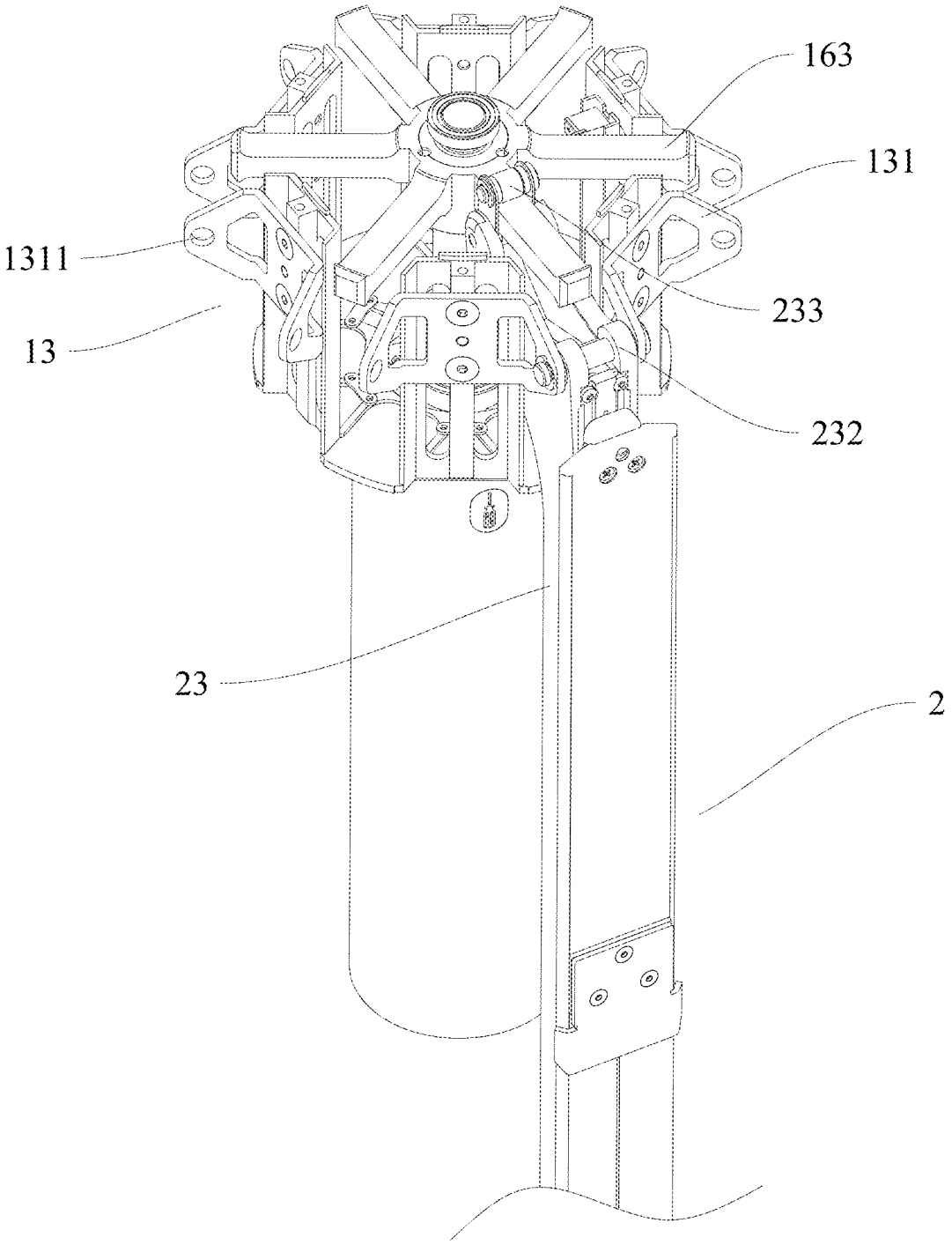
FIG. 8 is a schematic view showing that the second connecting portion is hingedly connected to the base in accordance with the preferred embodiment of the present invention.
Figure 9:
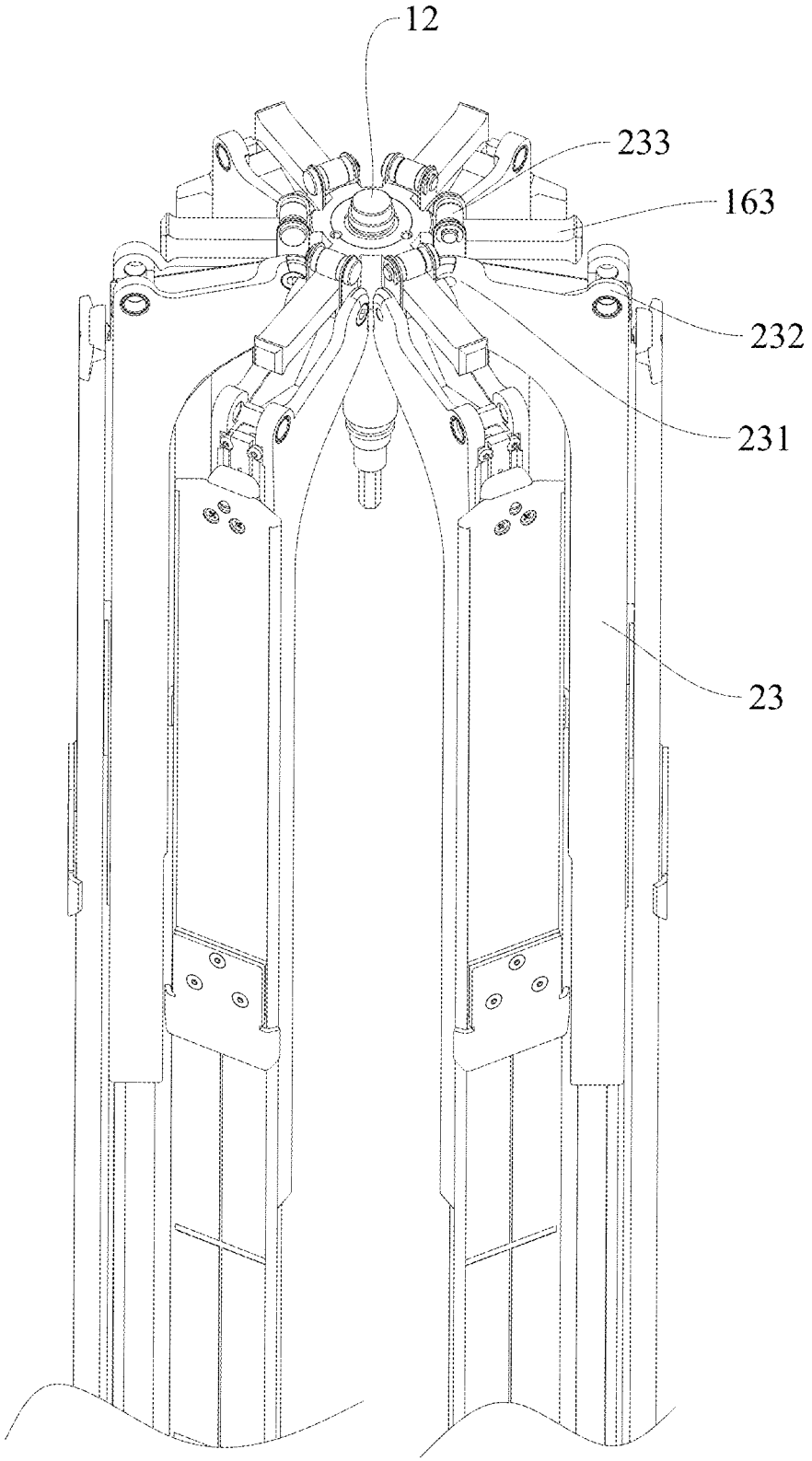
FIG. 9 is a schematic view showing that the rib assembly and the movable disk are in a closed state in accordance with the preferred embodiment of the present invention.
Figure 10:
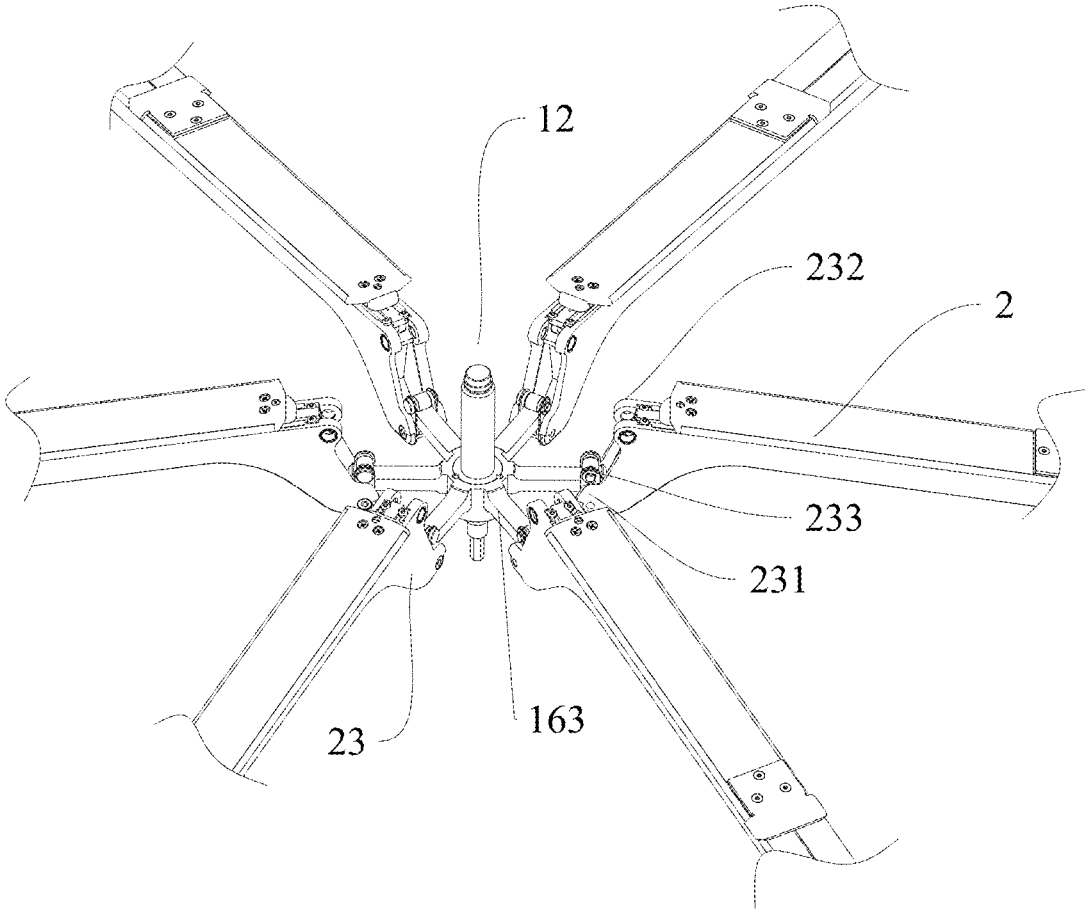
FIG. 10 is a schematic view showing that the rib assembly and the movable disk are in an open state in accordance with the preferred embodiment of the present invention.

The opening and closing of the umbrella provided by the present invention is described below. When the drive motor 11 is started, the screw rod 12 is driven to rotate and the movable disk 16 is driven to move up and down, thereby driving the movable end of the rib to roll on the guide rail 163 of the movable disk 16. Besides, the upward and downward movement of the movable disk 16 drives the first connecting portion 231 to rotate about the hinge point 1311, thereby changing the angle of the rib to be opened/closed, such that the umbrella can be opened/closed. Specifically, as shown in FIG. 8, the point (i.e., the hinge point) at which the second connecting portion 232 of the first connecting member 23 is hinged to the rib mounting seat 131 serves as the rotational fulcrum for the opening and closing of the rib. In order to understand the movement of the movable end of the rib, FIG. 9 and FIG. 10 illustrate the movable disk 16 connected to the rib assembly 2, and the base 13 is removed for clarity. As shown in FIG. 9, when the umbrella is closed, the movable disk 16 is moved up and the rolling member 233 is moved up along with the movable disk 16, the two rollers 2331 of the rolling member 233 slide inwardly along the guide rail 163 to the innermost end, and the first connecting portion 231 and the rib assembly 2 are rotated clockwise about the hinge point 1311 (refer to FIG. 8) to complete the closing of the umbrella. As shown in FIG. 10, when the umbrella is opened, the movable disk 16 is moved down and the rolling member 233 is moved down along with the movable disk 16, the two rollers 2331 of the rolling member 233 slide outwardly along the guide rail 163 to the outermost end, and the first connecting portion 231 and the rib assembly 2 are rotated counterclockwise about the hinge point 1311 (refer to FIG. 8) to complete the opening of the umbrella.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An electrically-operated opening and closing structure of a solar-charged umbrella, comprising a rib assembly and an electrically-operated opening and closing mechanism, the rib assembly including a main rib and a solar panel assembly; the electrically-operated opening and closing mechanism including a base, a drive motor, a screw rod, a movable disk and an immovable disk; the immovable disk being fixedly connected to an upper end of the base, the movable disk being located inside the base, the drive motor being located under the base and connected to a lower end of the screw rod, the electrically-operated opening and closing mechanism and the rib assembly being connected through a first connecting member; the movable disk having a central hole with an internal thread meshing with the screw rod, an outer side of the movable disk having a guide rail corresponding in number to the main rib;

wherein a front end of the first connecting member has a first connecting portion and a second connecting portion, a rear end of the first connecting member is fixedly connected to the main rib, a rolling member is provided on the first connecting portion, the rolling member is fitted on the guide rail and reciprocated along the guide rail, the second connecting portion is hingedly connected to the base, and the movable disk is moved axially relative to the base and drives the first connecting portion to rotate about a hinge point.

2. The electrically-operated opening and closing structure of the solar-charged umbrella as claimed in claim 1, wherein the first connecting portion is in the form of two lugs.

3. The electrically-operated opening and closing structure of the solar-charged umbrella as claimed in claim 1, wherein a rib mounting seat is provided on one side of the base, and the second connecting portion is hingedly connected to the rib mounting seat.

4. The electrically-operated opening and closing structure of the solar-charged umbrella as claimed in claim 1, wherein a travel switch is provided on an inner wall of the base, the travel switch is connected to the drive motor, the movable disk has a control lever, and the control lever interacts with the travel switch to restrict an upward and downward movement of the movable disk.

5. The electrically-operated opening and closing structure of the solar-charged umbrella as claimed in claim 1, wherein a motor mounting seat of the drive motor is provided under the base, the motor mounting seat is in the form of a hollow tube, a coupler assembly is provided in the motor mounting seat, and the coupler assembly connects the drive motor and the screw rod.

6. The electrically-operated opening and closing structure of the solar-charged umbrella as claimed in claim 5, wherein the coupler assembly consists of two couplers, and a spring is provided on an upper one of the two couplers.

7. The electrically-operated opening and closing structure of the solar-charged umbrella as claimed in claim 1, wherein a decorative cover is provided on an outside of the electrically-operated opening and closing mechanism, and the decorative cover includes an upper decorative cover and a lower decorative cover that are relatively closed.

8. The electrically-operated opening and closing structure of the solar-charged umbrella as claimed in claim 1, wherein a photosensitive sensor is provided on the immovable disk.

9. The electrically-operated opening and closing structure of the solar-charged umbrella as claimed in claim 1, wherein a second connecting member is mounted on top of the first connecting member, the second connecting member is an elongate plate with a raised step, and the solar panel assembly is fixed to the main rib through the second connecting member and the first connecting member.

10. The electrically-operated opening and closing structure of the solar-charged umbrella as claimed in claim 9, wherein the solar panel assembly includes a solar panel, a bracket and a conductive connector, the bracket is slidably inserted in the second connecting member, the bracket has a mounting groove, the solar panel is slidably inserted and secured in the mounting groove, and the conductive connector is located below the bracket.

* * * * *